United States Patent [19]

Strickland

[11] 4,231,541

[45] Nov. 4, 1980

[54] CONCRETE FORM PANEL TYING APPARATUS

[75] Inventor: James K. Strickland, Jacksonville, Fla.

[73] Assignee: Strickland Systems, Inc., Jacksonville, Fla.

[21] Appl. No.: 826,834

[22] Filed: Aug. 22, 1977

Related U.S. Application Data

[63] Continuation-in-part of Ser. No. 576,861, May 12, 1975, abandoned, and Ser. No. 576,862, May 12, 1975, Pat. No. 4,044,986.

[51] Int. Cl.[3] ..... E04G 17/08

[52] U.S. Cl. ..... 249/216; 249/42; 249/46; 249/219 R

[58] Field of Search ..... 249/40–46, 249/190, 191, 213–214, 216–217, 219 R, 219 W

[56] References Cited

U.S. PATENT DOCUMENTS

| | | | |
|---|---|---|---|
| 2,270,448 | 1/1942 | Juhl | 269/243 |
| 2,620,542 | 12/1952 | Fontaine | 249/42 |
| 3,010,175 | 11/1961 | Shoemaker | 249/45 |
| 3,292,893 | 12/1966 | Williams | 249/42 |
| 3,633,867 | 1/1972 | Eriksson | 249/42 |
| 3,881,684 | 5/1975 | Daniels, Jr. | 249/40 |
| 3,920,214 | 11/1975 | Lovisa et al. | 249/40 |
| 3,984,079 | 10/1976 | Gates | 249/42 |
| 4,044,987 | 8/1977 | Tausanovitch et al. | 249/219 W |
| 4,052,032 | 10/1977 | Lovisa et al. | 249/40 |

FOREIGN PATENT DOCUMENTS 872996 7/1961 United Kingdom .

*Primary Examiner*—John McQuade
*Attorney, Agent, or Firm*—Schuyler, Birch, McKie & Beckett

[57] ABSTRACT

Apparatus for tying together concrete form panels includes an elongated tie and means attachable to a concrete form panel for clamping the tie to restrain relative movement between the tie and the form panel. The tie has end portions of a first transverse dimension and adjacent longitudinally inward portions of a second and smaller transverse dimension with a longitudinally outwardly sloped surface extending between each such inward portion and its adjacent end portion. The tie end portions may be either integral with the rest of the tie, or separate threaded members. The clamping means includes at least one member movable between a clamping position receiving the tie and a nonclamping position away from the tie. This clamping member has a recess for matingly receiving the longitudinally inward portion of the tie, and the portions of the clamping member adjacent the recess and distal the form panel engage the sloped surface of the tie when the clamping member is moved into the clamping position.

28 Claims, 18 Drawing Figures

FIG.13
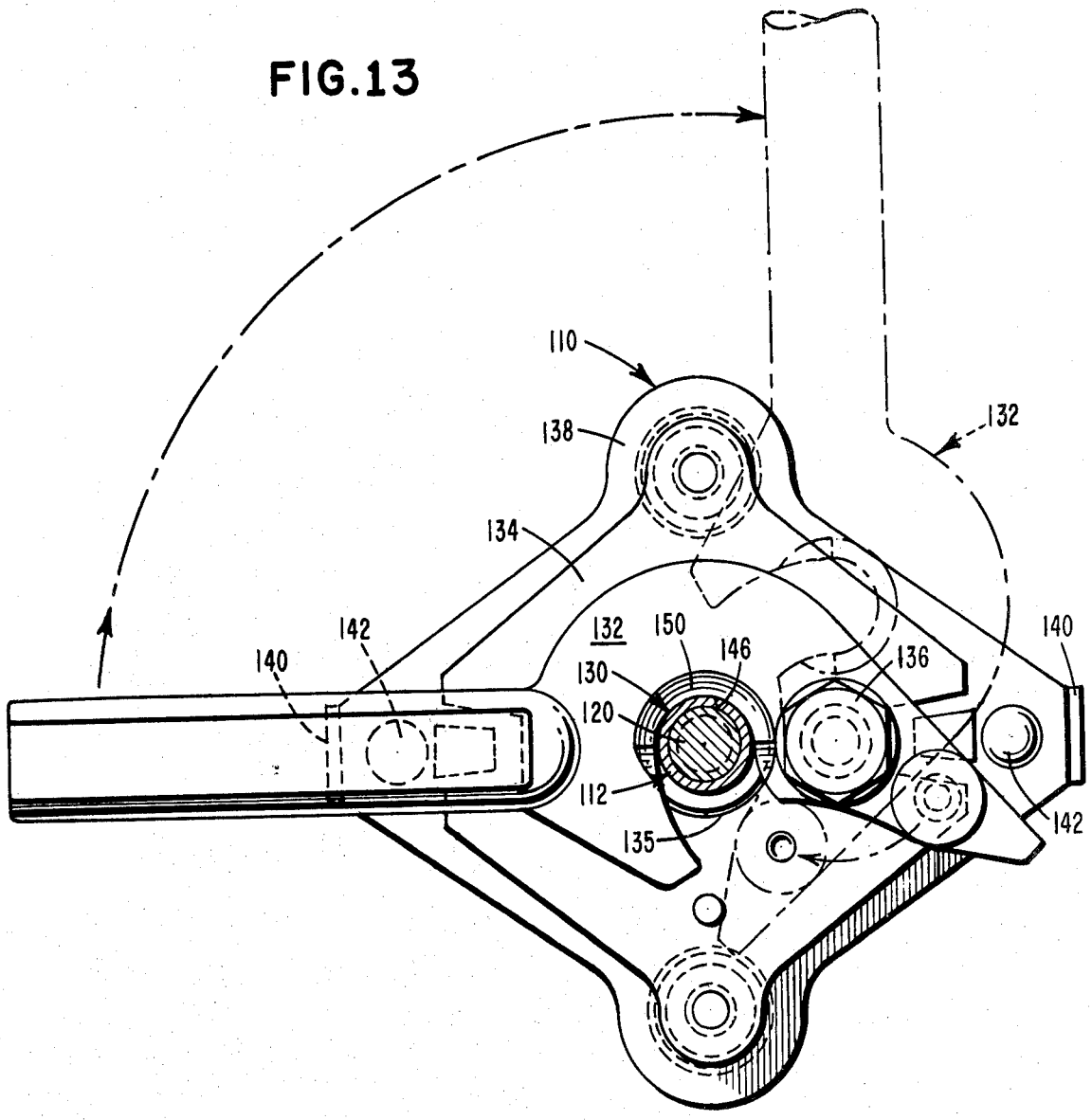
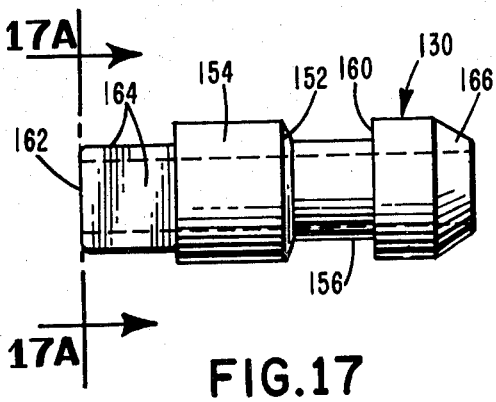
FIG.17
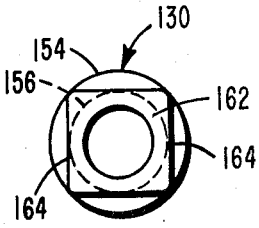
FIG.17A

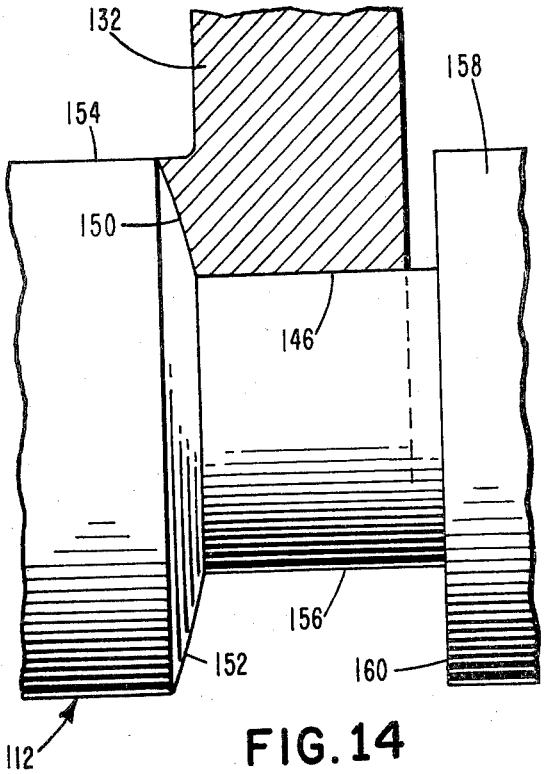
FIG.14
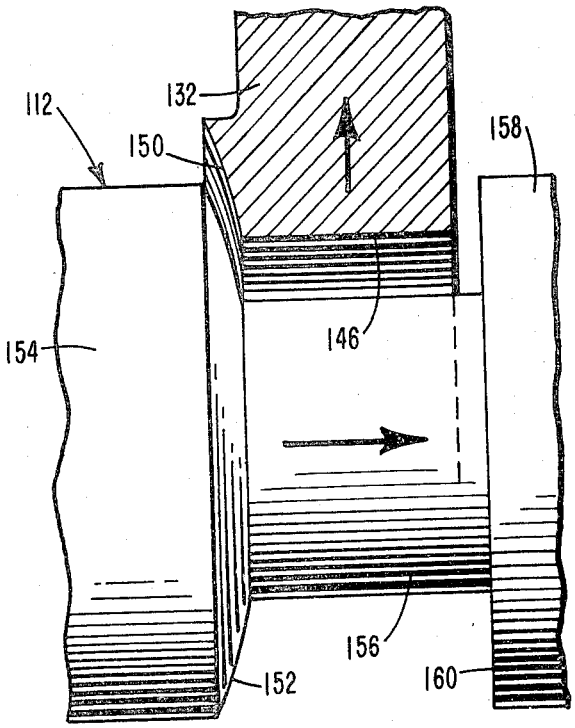
FIG.16
FIG.15
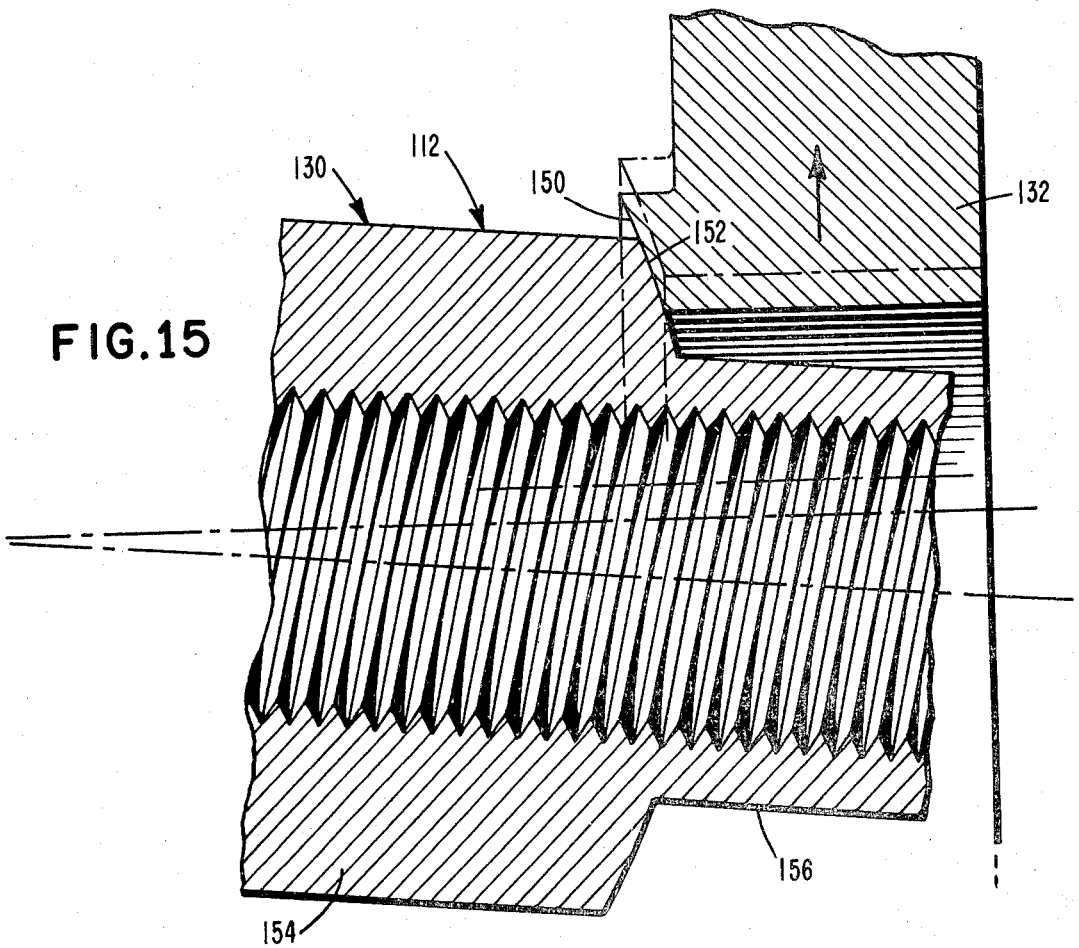

CONCRETE FORM PANEL TYING APPARATUS

CROSS REFERENCE TO RELATED APPLICATIONS

This is a continuation-in-part of copending applications Ser. No. 576,861, filed May 12, 1975 and now abandoned, and Ser. No. 576,862, filed May 12, 1975 and now U.S. Pat. No. 4,044,986.

BACKGROUND OF THE INVENTION

This invention relates to the field of concrete construction and more particularly to the field of concrete construction formwork and apparatus for assembling such formwork into functional units. Specifically, this invention relates to apparatus for tying formwork panels together by means of elongated ties and fastening devices attachable to the panels to secure the ties and panels against relative movement.

To construct concrete forms from panels maintained in spaced opposed relationship numerous prior art devices have been proposed and utilized with varying degrees of success. These devices have generally comprised a rod extending between and through both such panels with varying forms of wedging or locking devices provided to grip the ends of the tie and thus prevent outward movement of the form panels. With devices of this nature the forms are generally provided with spacers to prevent inward movement thereof, and the rod end fastening devices are attached to walers on the form panels. These rod end fastening devices have generally taken the form of loops through which hooks are inserted, or nuts threaded onto the end of a threaded tie rod, or a hot-upset end similar to the head of a nail or bolt. A major disadvantage that all such apparatus has suffered has been the difficulty of removal of the fastening device after the concrete structure has been poured and set. This problem is caused by the expansion of the concrete during setting greatly increasing the outward pressure against the form panels and thus against the tie rod end fastening devices. Accordingly, it has required great force to release these prior art devices in order to remove the form panels. This difficulty in removing the fastening devices has resided principally in the inability of such devices to release the longitudinal stresses on the rods quickly upon the initiation of the releasing action.

Accordingly, it is an object of this invention to provide concrete form panel tying apparatus which may quickly and easily be installed to clamp form panels into place and may quickly and easily be removed to release such panels, even when such panels are under great pressure from the concrete structure formed within.

SUMMARY OF THE INVENTION

This invention, in brief, involves concrete form panel tying apparatus comprising an elongated tie having end portions of a first transverse dimension and having adjacent longitudinally inward portions of a second and smaller transverse dimension with a longitudinally outwardly sloped surface extending between each said inward portion and said adjacent end portion, and means attachable to a concrete wall form panel for clamping said tie to restrain relative movement between said tie and the form panel, said clamping means comprising at least one member movable between a clamping position receiving said tie and a nonclamping position away from said tie, said member having a recess therein for matingly receiving said longitudinally inward tie portion, the portions of said member adjacent said recess and distal the form panel having a sloped surface complementary to and engaging said sloped surface of said tie when said clamping member is moved into said clamping position. The end portions and adjacent inward portions of the tie may be threadedly connected to the main body part of the tie.

BRIEF DESCRIPTION OF THE DRAWINGS

The structure of this apparatus may be understood more clearly by reference to the illustrative embodiments of the accompanying drawings in which;

FIG. 13 is an elevational view, partially in section, of the form panel tying apparatus of FIGS. 9–11;

FIG. 14 is a partial vertical section illustrating the manner of engagement between the tie and clamping member of this invention, with a portion of the clamping member shown in section;

FIG. 15 is a fragmentary view in vertical section of the tie and clamping member of this invention with such members angularly misaligned to illustrate a feature of this invention;

FIG. 16 is a vertical section similar to FIG. 14, illustrating the manner of releasing engagement between the tie and clamping member of this invention at the initiation of the movement of the clamping member, shown in section, toward its nonclamping position out of engagement with the tie;

FIG. 17 is a side elevation of a device for anchoring a threaded tie to a form panel; and FIG. 17A is an end elevational view of the anchoring device taken along line 17A—17A of FIG. 17.

DETAILED DESCRIPTION OF THE INVENTION

Figure 2:
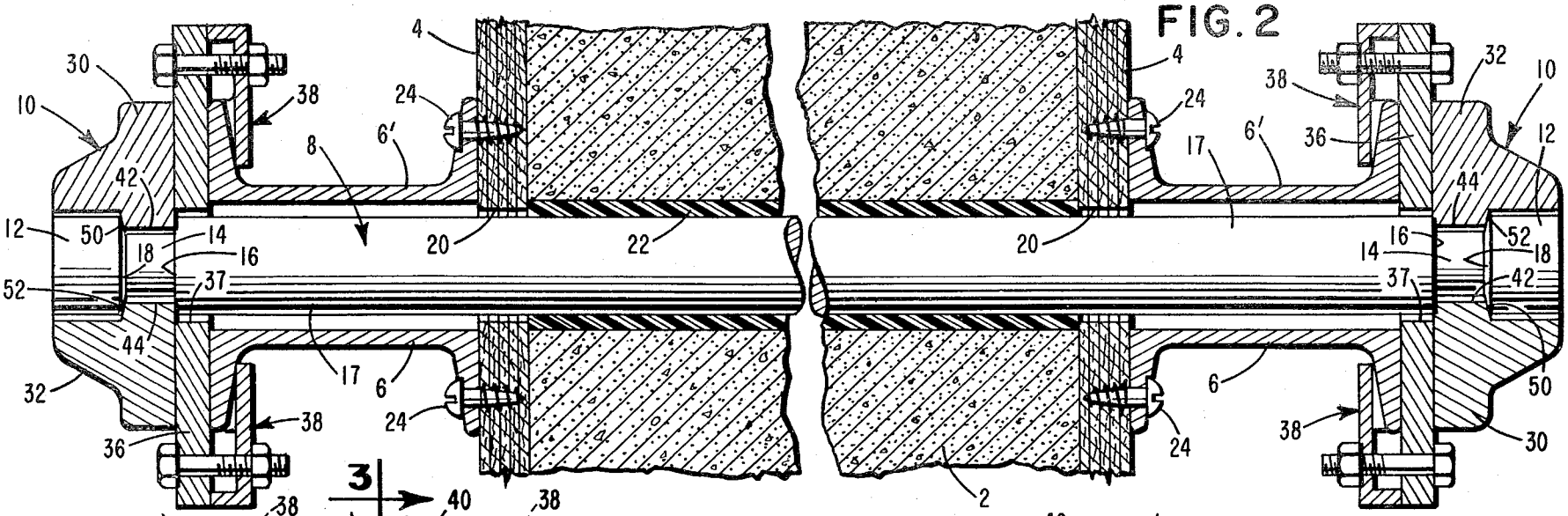
FIG. 2 is a sectional view of the apparatus and installation of FIG. 1, taken along line 2—2 of FIG. 1.
Figure 3:
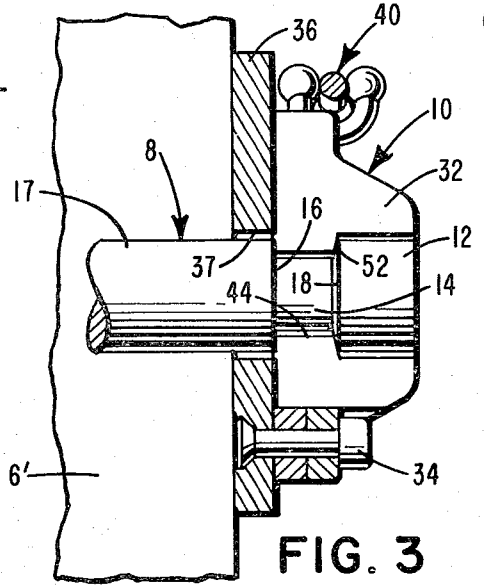
FIG. 3 is a partial sectional view of the apparatus of FIG. 1, taken along line 3—3 of FIG. 1.
Figure 1:
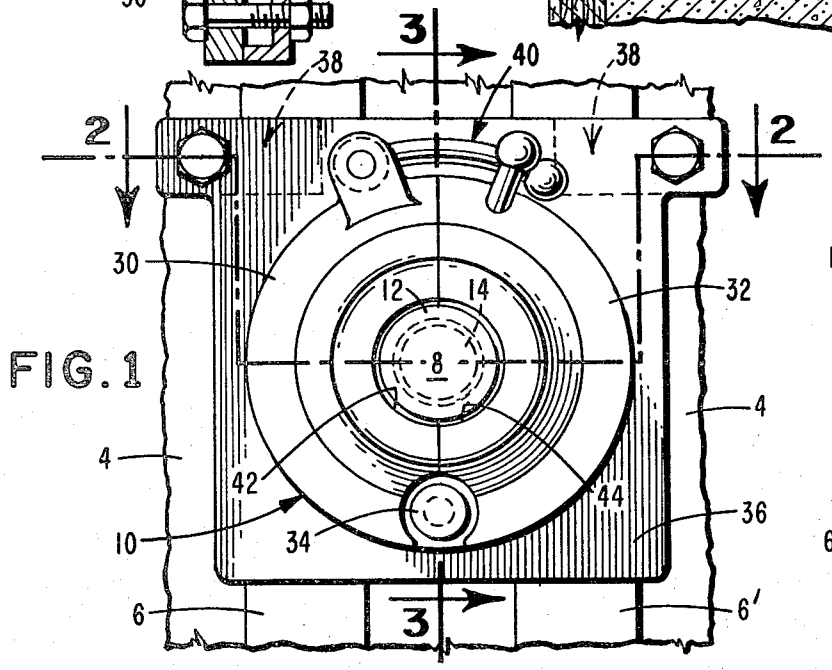
FIG. 1 is a side view of the apparatus of this invention with the clamping means in the clamping position, representing a typical installation in constructing a concrete wall panel.

In FIGS. 1, 2 and 3 the apparatus of this invention is illustrated in conjunction with concrete form panels such as may conveniently be used in the fabrication of a concrete wall. In such an arrangement substantially identical clamping structure may conveniently be used with the panels and panel ties on opposite sides of such wall. Accordingly, in this illustrative embodiment the same reference numerals will be used to designate corresponding components on opposite sides of such a wall.

The concrete wall being formed is generally indicated by reference numeral 2, with the adjoining form panels, suitably of plywood, indicated by the numeral 4. Walers 6 and 6', suitably fabricated of steel channel or, if desired, wood members, are shown fastened to the panels 4 to increase the rigidity thereof. While only one tying apparatus is illustrated with this form, it is to be understood that a plurality of such walers and tying structures could be used with such a panel if necessary.

A formwork tie, generally denoted by the numeral 8, extends through the concrete wall structure and apertures 20 in the formwork panels 4 and projects beyond the outermost extent of the walers 6 and 6'. Clamping means for securing the tie 8 to the walers, and thus the formwork panels, is generally indicated by the numeral 10. By means of the use of the tie 8 and the clamping means 10, the opposing formwork panels 4 may be clamped in position a predetermined distance apart and restrained against movement either toward or away from one another, as will be explained more fully below.

The tie 8 of this embodiment comprises an elongated member which may conveniently be formed from a continuous solid rod of circular cross section, although other cross sections and structural configurations may function equally well. The end portions 12 of this elongated tie 8 are of a suitable transverse dimension, or diameter, conveniently that of the maximum diameter of the rod. These end portions 12 extend longitudinally of the tie a length at least sufficient to give the desired strength against longitudinally applied forces to be described later; a suitable length might be on the order of one inch. Immediately adjacent these end portions 12 are portions 14 of the tie having a second and smaller transverse dimension or diameter and disposed longitudinally inwardly of the end portions 12. In the embodiment of FIG. 1 these smaller portions are suitably illustrated as peripeheral or circumferential grooves 14 machined into the tie adjacent the end portions 12. A suitable ratio of diameters for the end portions and the base of the groove 14 might be on the order of $1\frac{1}{4}$ inches for the end portion 12 and $\frac{3}{4}$ inch for the inward grooved portion 14. The shoulder or surface 16 extending between the base of the groove 14 and the larger diameter inward portion 17 of the tie 8 may be either sloped or normal to the access of the tie. However, it is an important feature of this invention that the outer shoulder of this groove, the surface 18 extending between the base of the groove 14 and the adjacent end portion 12, be at least slightly chamfered or sloped in a longitudinally outward direction. The purpose of this sloped surface will be more fully explained below.

In FIG. 2 the tie 8 is illustrated as projecting through apertures 20 of concrete form panels 4 and thence between and outwardly of water channels 6 and 6'. A conventional protective sleeve 22 is also illustrated as surrounding the tie 8 between the inner faces of form panels 4 to facilitate later removal of such tie 8 in a conventional manner.

Walers 6 and 6' may be fastened to form panels 4 by any convenient means, such as by wood screws 24, with the walers conventionally extending generally vertically and positioned on opposite sides of form panel apertures 20.

Figure 4:
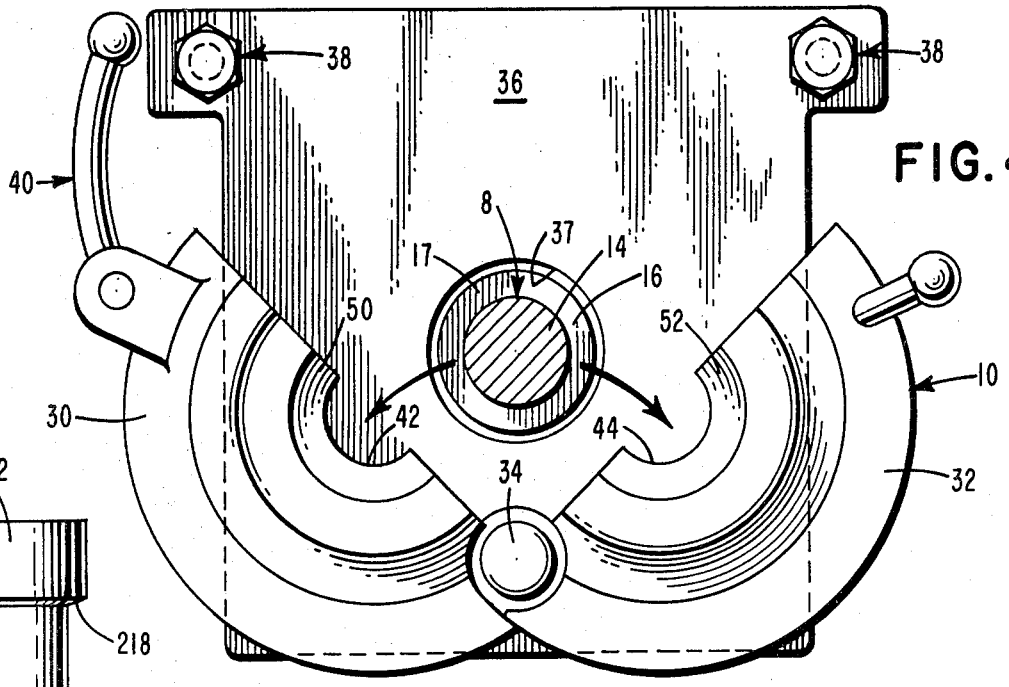
FIG. 4 is a front view of the structure of FIG. 1 with the clamping means in the nonclamping position and with the end portion of the tie rod removed to illustrate relative transverse dimensions of the rod.

Releasably attached to the outer flanges of each pair of walers 6 and 6' is a tie clamp 10. This clamp suitably comprises movable members 30 and 32, respectively, which may conveniently be pivotally connected to one another by a pin or bolt arrangement 34 as illustrated in FIGS. 1, 3 and 4. This pivot bolt 34 joining the two clamp members 30 and 32 may also conveniently attach such members to backing plate 36, as shown in FIG. 3. Backing plate 36, having aperture 37 therethrough for receiving the tie 8, may in turn be attached to the outer waler flanges by suitable clamping structure, generally indicated by numeral 38, thus attaching the entire clamp 10 to the form panels 4.

Tie clamp members 30 and 32 are each selectively movable between a clamping position receiving the tie 8, as illustrated in FIG. 1, and a nonclamping position away from the tie, as illustrated in FIG. 4. When in the clamping position the clamp members desirably are releasably fastened together by any conventional fastening means 40, such as the latch arrangement shown.

In each clamp portion 30 and 32, there is provided a recess 42 and 44, respectively, for matingly receiving the longitudinally inward tie portion 14, as shown in FIGS. 2 and 3. These recesses 42 and 44 desirably are located in the mating faces of clamp members 30 and 32, such that joining these members 30 and 32 will define an aperture extending through the clamp. In the illustrative embodiment the recesses are semicircular in configuration thus to provide a circular aperture through the clamp. The transverse dimension, or diameter, of this clamp aperture is of a magnitude between that of the tie end portion 12 and that of the immediately adjacent longitudinally inward portion 14 of the tie. If the portions of these clamp members immediately adjacent the aperture are of a thickness not greater than the length of the notch 14 of the tie, as shown in the illustrative embodiments, movement of the clamp portions 30 and 32 to the closed position about the groove 14 serves to clamp the tie against any substantial movement relative to the clamps 10 and thus relative to the forms 4.

To facilitate both clamping and later disengagement between the clamp 10 and the tie 8, as described below, the outwardly facing portions 50 and 52 adjacent the recesses 42 and 44 of these clamp members are sloped toward the form panels 4 and toward the recesses 42 and 44, respectively, thus giving these portions of the clamp members an inwardly sloping configuration which desirably corresponds to the sloping configuration of the groove shoulder 18 of the tie 8. Thus, when the clamp members 30 and 32 are in their clamping position receiving the tie 8, the sloping surfaces 50 and 52 of the clamp members 30 and 32 matingly engage the corresponding sloping surface 18 of the tie thus to give a solid load-distributing seat for the tie within the clamp.

A substantial benefit of this arrangement also comes upon release of the clamp for removal of the form panels. When such release is desired, the slight displacement of the clamp members 30 and 32 from their mating clamping position about the tie, as caused by the initiation of the movement of these two portions toward their open, nonclamping position, quickly relieves the longitudinal stress exerted by the clamp 10 upon the tie 8 in the following manner. Movement of the sloped clamp surface away from the correspondingly sloped tie groove shoulder surface 18 quickly permits slight longitudinal movement of the tie inwardly of the clamp and form panel, thus relieving the stresses and strains created by the expansion of the concrete structure during the curing process. This stress and strain relieving longitudinal movement between the tie and the clamp is permitted upon the initiation of the clamp opening operation, even before the clamp is fully removed from its position entrapping the head 12 of the tie. This manner of operation is in clear contradistinction to that of the prior art structures having clamping means surrounding an enlarged tie end structure. In those prior art devices the mating surfaces are seen generally to be normal to the axis of the tie. Such structure requires full and complete disengagement between the clamp and the tie before any of the longitudinal strain can be relieved, a condition frequently rendering difficult the release of such tie fastening structures. Accordingly, the apparatus of the present invention provides for both easy assembly of the tie and form panel structures and for easy and rapid dismounting thereof.

Figure 5:
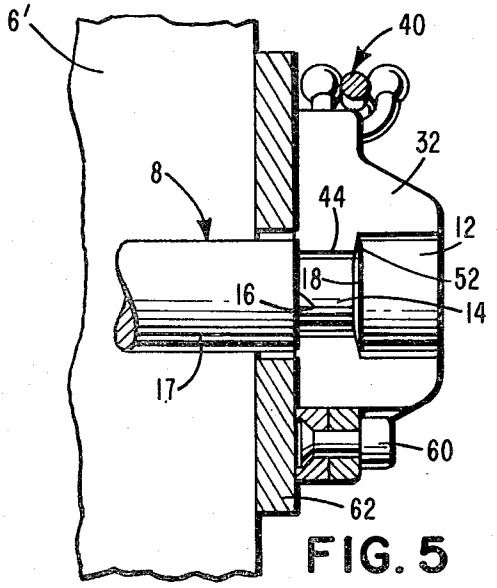
FIG. 5 is a partial sectional view, similar to FIG. 3, of another embodiment of the apparatus and installation of FIG. 1.

FIG. 5 depicts a variation of the structure of FIGS. 1–4 wherein the only difference is pivotal connection of clamp portions 30 and 32 to one another by means of pivot pin or bolt 60 without attachment of such structure to backing plate 62. This embodiment would obviously function equally as well as the above-described embodiment in restraining outward movement of the form panels. However, a spacer might be required to hold the form panels apart prior to the introduction of the concrete, since this embodiment of the clamp is attached to the form panels only by virtue of its clamping engagement of the tie and thus cannot restrain the panels from inward movement.

Figure 6:
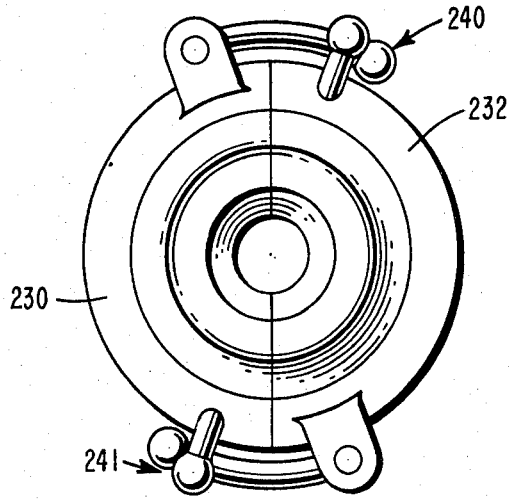
FIG. 6 is a front view of a third embodiment of the clamping means of this invention, in its clamping position.
Figure 7:
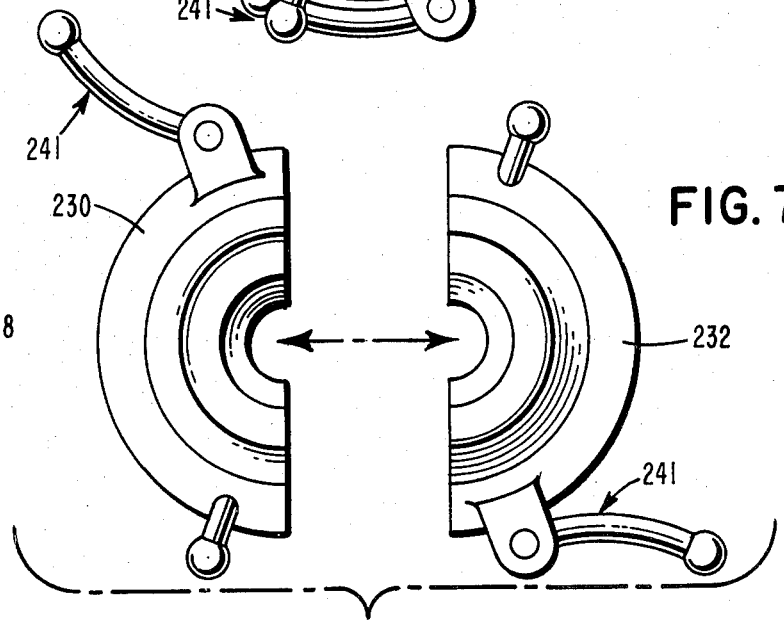
FIG. 7 is a front view of the clamping means of FIG. 6 in its open, nonclamping position.

A third embodiment of the clamping means of this invention is depicted in FIGS. 6 and 7. The components of the structure of this embodiment are substantially similar to those described above, but without the pivotal connection between the two clamp members 230 and 232. Instead, the clamp members 230 and 232 are fully separable from one another when in the open position and are held together in the mating position by a pair of conventional latching devices 240 and 241.

Figure 8:
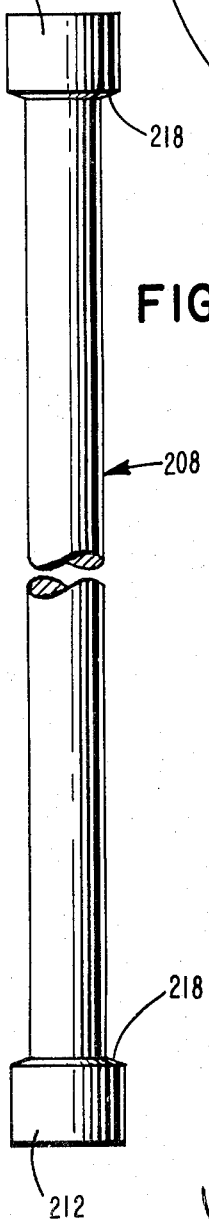
FIG. 8 is an alternative embodiment of the elongated tie of this invention.

FIG. 8 depicts an alternative embodiment of the elongated tie of the previous embodiment. This tie 208 incorporates end portions 212 substantially identical to those end portions 12 of the previous embodiment, and sloping surfaces 218 generally corresponding to surfaces 18 of the previous embodiment. However, in this embodiment substantially all portions of the tie inward of the end portions 212 are of the smaller second transverse dimension, corresponding generally to the diameter of the base of the slot 14 on the previous embodiment. As with the clamp configurations of FIGS. 5, 6 and 7, this tie 208 would serve equally as well as the grooved tie 8 in the previous embodiment for restraining outward movement of the form panels. However, the absence of an inner shoulder corresponding to the shoulder 16 of tie 8 would prevent this alternative embodiment 208 from exerting substantial force to restrain inward movement of the form panels, thus possibly necessitating the use of a spacer between the form panels.

The embodiment of FIGS. 1–8, instead of a one piece tie, may utilize threaded ties having a nut corresponding to the tie end portions and having the disclosed sloped surfaces. FIGS. 9–17 illustrate the application of such a tying apparatus to a pair of substantially identical opposed concrete form panels 102. These form panels 102, of any desired height and width, may suitably comprise plywood panels 104 braced with horizontal wooden walers 106 and vertical steel channel walers 108. Releasably attached to the vertical walers 108 are a plurality of tie anchoring clamping units 110 for releasably clamping the form panels 102 to ties 112 extending through the concrete structure, which here is illustrated as a vertical wall.

The ties 112 may conveniently comprise either a solid steel member or, as illustrated here, a threadedly connected multi-part steel structure. In this embodiment the tie 112 comprises an inner tie 116 permanently and nonrotatably imbedded in the concrete and having threaded ends, each of these ends threadedly received into an elongated tapering nut 118. The nut 118 in turn is threaded onto outer tie 120 and affixed thereto by pin 122 extending through both the nut 118 and the outer tie 120. The outermost extremity 124 of the outer tie 120 conveniently may be provided with a square head formed by opposed flats 125 to facilitate rotation thereof by a wrench for later removal of the outer tie 120 and tapered nut 118 from the concrete structure. This inner tie, if desired, could be made removable by encasement within a plastic sleeve extending between the form panels 102. The illustrated clamping engagement of the tie 112 by the clamping unit 110 secures the form 102 against any substantial displacement longitudinally of the ties 112. Conveniently, a "kick strip" 126 may be secured to the subjacent supporting structure 128 to provide a stop to prevent any outward movement of the base of the form panels 102.

Figure 9:
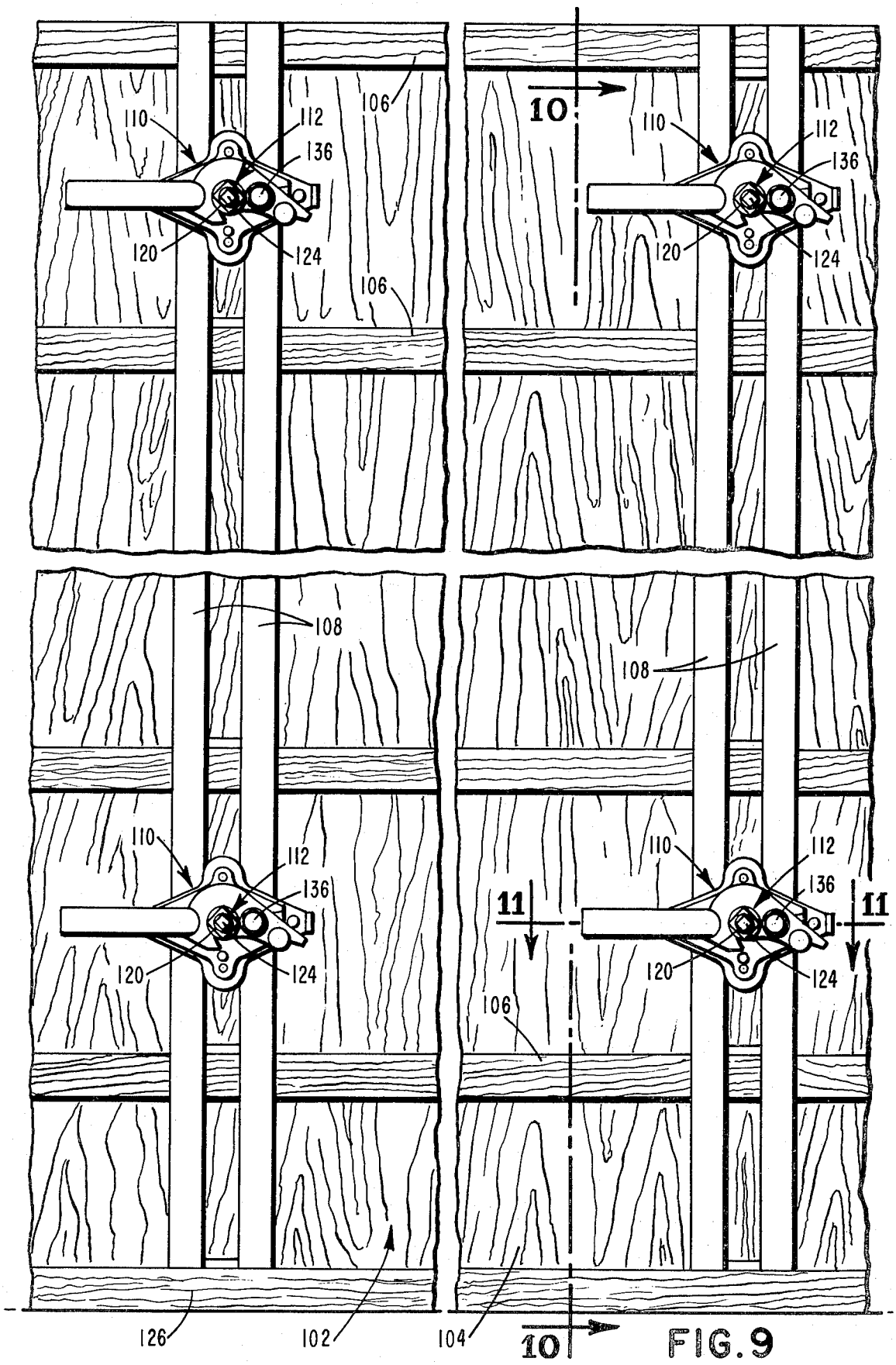
FIG. 9 represents a typical installation of a fourth embodiment of the concrete form panel tying apparatus of this invention.
Figure 10:
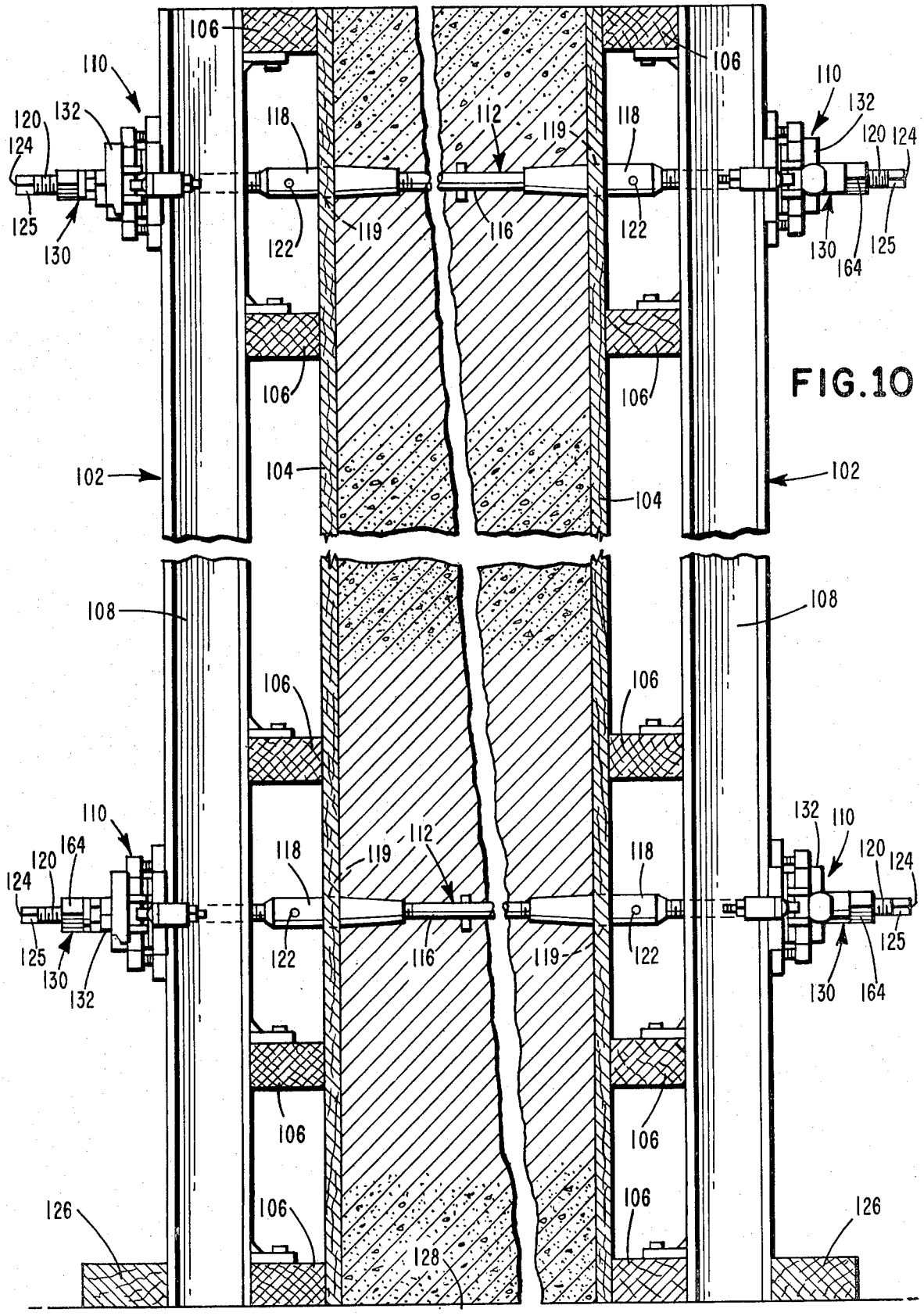
FIG. 10 represents a vertical section through the installation taken along line 10—10 of FIG. 9.
Figures 11, 12:
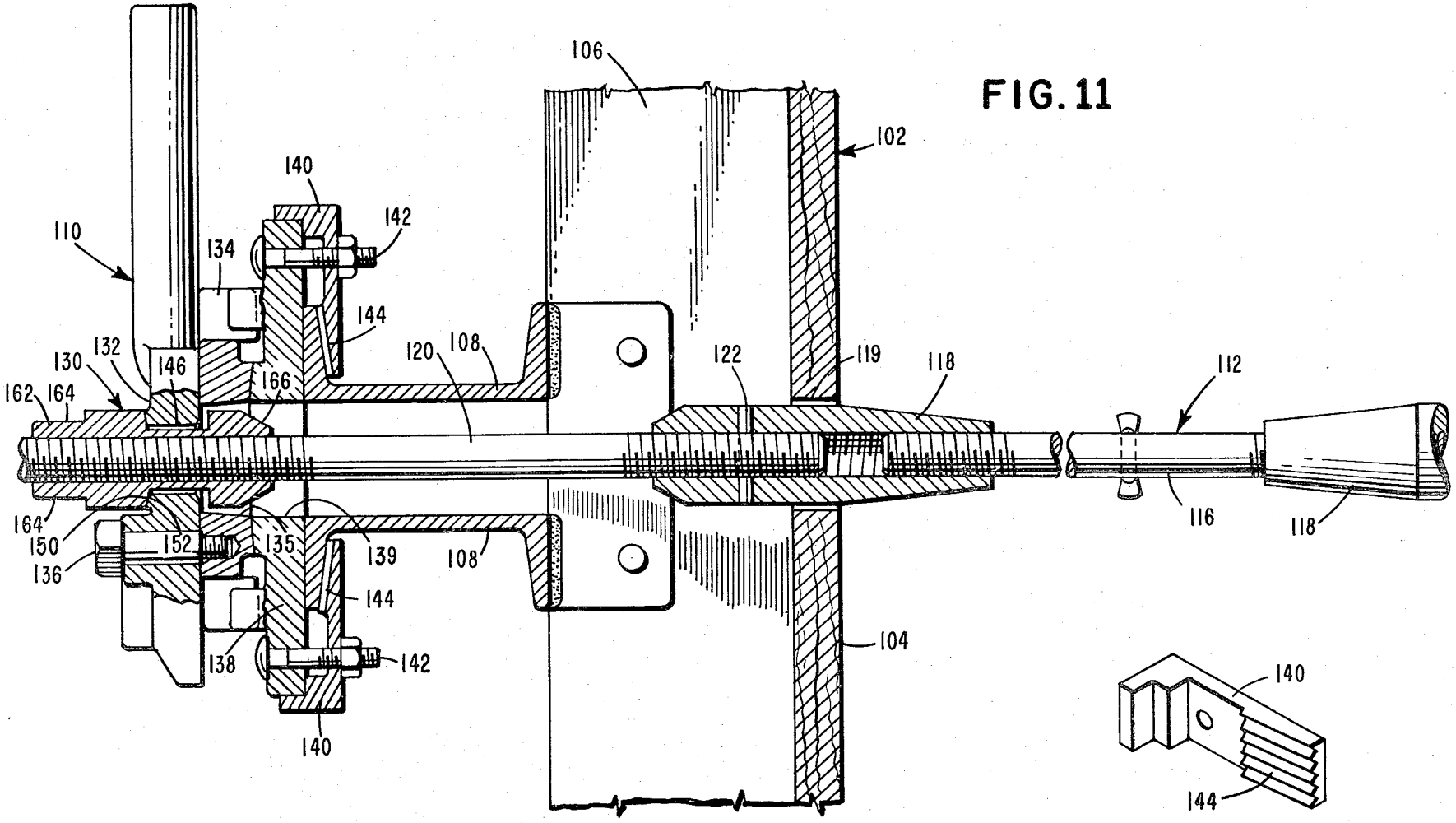
FIG. 11 represents a horizontal section taken through the concrete form panel tying apparatus of FIG. 9, taken along line 11—11 of FIG. 9.
FIG. 12 illustrates one of the devices used for attaching the formwork tying apparatus of FIG. 11 to a waler.

The detailed structure of the tying apparatus of FIGS. 9 and 10 is more clearly illustrated in the horizontal section of FIG. 11. This figure illustrates the manner in which the elongated, tapered connecting nut 118 joins the inner tie 116 to the outer tie 120, to which the nut 118 is pinned. The nut 118 extends through a closely fitting aperture 119 in panel 104, with the longitudinally tapering portion projecting inwardly of the panel. Such a longitudinal taper facilitates removal of the nut 118 after the concrete structure has set. The longitudinally outer portion of outer tie 120 extends between vertical walers 108 and through apertures in the clamping apparatus 110 and threadedly receives the internally threaded anchoring nut 130, illustrated more clearly in FIGS. 17 and 17A. By virtue of the engagement of this anchor nut 130 with the clamping structure 110, the position of the nut 130 longitudinally of the outer tie 120 effectively determines the positioning of opposing form panels 102.

FIG. 11 also illustrates the tie anchoring clamping apparatus 110, which includes a clamping member 132 engaging the anchor nut 130, a mounting member 134 to which the clamping member 132 is pivotally attached by means of shoulder bolt 136, and bearing member 138, which abuts the flanges of walers 108 and bears the inward forces exerted by the remainder of the clamping structure and is attached to mounting member 134. Each of such members 132, 134 and 136 suitably may be fabricated of ductile steel. As indicated, the anchor nut 130 is received through apertures 135 and 139 of members 134 and 138, respectively, with aperture 135 only slightly larger in diameter than the tie portion projecting therethrough and aperture 139 substantially larger than such tie portion, to facilitate clamping and alignment of the tie. Conveniently, bearing member 138 may releasably be attached to the waler flanges by gripping members 140, illustrated in FIG. 12, which are received onto studs 142 projecting inwardly from bearing member 138. These gripping members 140 desirably are provided with teeth 144 which extend horizontally in the installed position, thus to restrain the tie anchoring clamping structure 110 against sliding down the waler when attached thereto.

In the view of FIG. 13 the apparatus of this invention is shown with the clamping member 132 both in its clamping position (solid line representation) engaging the tie 112, shown in section, and with the clamping means 132 pivotally moved to its nonclamping position away from the tie (phantom line representation). When this clamping member 132 is in its clamping position, it may be seen that recess 146, in the form of an arcuate slot in the clamping member 132, is matingly received about a portion of the tie 112. Since the tie 112 of this preferred embodiment is round and the recess 146 is configured to correspond with the cross-sectional configuration of the tie, the inner end of the recess 146 is semicircular and of a diameter only slightly greater than that of the portion of the tie 112 received therein.

When the clamping member 132 is in its clamping position engaging the tie 112, it may be seen from FIG. 10 that there is engagement between clamping member surface 150 and tie anchor nut shoulder 152 to restrain any motion of the form 102 longitudinally outwardly of the tie 112. In the view of FIG. 13 it may be seen that the tie engaging surface 150 of the clamping member 132 comprises the portion of the member 132 adjacent the semicircular end portion of the slot 146. As seen most clearly in FIG. 11, this clamping member surface 150 and the mating surface 152 of the tie slope longitudinally inwardly of the tie 112 toward the form panel 102 and slope inwardly toward the recess 146. For reasons to be described more fully below, the sloping surface 152 of the tie preferably is convexly sloped, at least at the radially outer portions thereof. Similarly, the mating sloping surface 150 of the clamping member 132 preferably is concavely curved. These mating surface configurations provide both for angular misalignment and for easy removal of the tie and clamping structure. However, both surfaces 152 and 150 could have a straight line sloped surface similar to that of surfaces 18, 50 and 52 in solid tie 8 if so desired.

As is illustrated most clearly in FIG. 14, the engagement between clamping member 132 and tie 112 occurs by engagement of surface 150 of the clamping member with surface 152 of the tie. In this case, the tie comprises an end portion 154 having a first diameter or transverse dimension. Adjacent this end portion 154 is a longitudinally inward portion 156 having a second and smaller diameter or transverse dimension. Extending between outer portion 154 and longitudinally inward portion 156 is the surface 152 will preferably at least the radially outward portions thereof having a convex curvature and thus sloping longitudinally outwardly of the tie. Preferably, as in the illustration, the entire surface 152 is convexly curved and sloping longitudinally outwardly. Axially adjacent the second tie portion 156, and opposite surface 152, is the tie third portion 158 having a diameter or transverse dimension greater than that of portion 156 and desirably equal to that of outer portion 154. Conveniently, a shoulder surface 160 extends radially outwardly from second portion 156 to the radially outer extremity of third portion 158 to engage clamping member 132 and prevent inward movement of the form panel.

The concave curvature of the surface 150, sloping inwardly toward the form panel and configured to mate with tie surface 152 provides substantial additional benefits to the use of this structure. As is most readily apparent in FIG. 13, this concave sloped surface 150 comprises the portion of the clamping member 132 immediately adjacent the semicircular end portion of the slot 146. Thus, supportive engagement between the clamping member 132 and the tie 112 occurs around that semicircular surface 150. By virtue of the curved, and preferably spherical mating surfaces 150 and 152, the engagement of these members forms a portion of a ball and socket joint. Accordingly, slight angular misalignment between the tie 112 and the axis of the clamping structure may be compensated by this ball and socket arrangement, as shown in the exaggerated representation of FIG. 15. Thus, even in a condition of such misalignment as might be caused by a 1¼ inch displacement of opposing form panels spaced only 12 inches apart, longitudinal stresses exerted by the formwork against the tie remain relatively evenly distributed over the full semicircular engagement and are not significantly concentrated on a small portion of the tie. This structure substantially avoids the imposition of bending moments such as might be created if the mating surface of the tie and the clamping member were flat.

A second benefit from this structure, stemming largely from the sloping curved configuration of the mating surfaces 150 and 152, is illustrated in FIG. 16 and by the broken line representation in FIG. 15. These figures illustrate the relative action of the tie 112 and the clamping member 132 upon the initiation of movement of the member 132 from its clamping position to its nonclamping position. By virtue of the sloped curved surface even slight movement of the member 132 away from its clamping position, as indicated by the arrows in FIGS. 11 and 12, permits the tie 112 to move relatively axially inwardly of the clamping member 132, thus relieving the axial or longitudinal stresses developed in the tie by the expansion of the concrete structure during curing. Accordingly, the longitudinal stresses are relieved substantially immediately upon the initiation of such movement, so that the effort required for complete removal of the clamping member 132 to its nonclamping position is reduced substantially from that which would be obtained through the mating of tie and clamping member surfaces substantially normal to the axis of the tie.

While a continuous solid tie is suitable in many instances, the preferred embodiment described above incorporates a threaded tie with the above described clamping member engaging surfaces formed on a nut threadedly inserted onto the end of such tie, as described above. Such a nut, suitable for use on any threaded tie, is more clearly illustrated in FIGS. 17 and 17A. In addition to the structure illustrated in the enlarged representations of FIGS. 14–16, it may be seen that the outermost sections of the outer end portion 154, adjacent the outer surface 162 have two pairs of radially opposed flats 164 machined therein parallel to the nut axis. These flats facilitate gripping by a wrench for rotation of the nut. Additionally, adjacent the third portion 158 of the nut is a second conically tapering end portion 166 to facilitate insertion of the nut 130 into the relatively close-fitting aperture 135 of the mounting member 134 during assembly of the tie and clamping structure. Another substantial advantage of this threaded tie and anchoring nut structure is the readily available means for adjusting the effective length of the tie by screwing the anchor nut 130 longitudinally inwardly or outwardly of the tie.

While preferred embodiments of the present invention have been described herein, various other modifications would be apparent to one skilled in the art. Therefore, the scope of the invention is to be limited only by the appended claims.

I claim:

1. Concrete form panel tying apparatus for restraining outward movement of a concrete form panel with respect to a tie passing therethrough, said apparatus comprising:

a tie extendable outwardly through an opening in said concrete form panel, an outer end portion on said tie having a first transverse dimension, an inner end portion on said tie located inwardly of said outer end portion and having a second transverse dimension less than said first transverse dimension, an outwardly inclined tie surface extending between said outer end portion and said inner end portion, and curved about the longitudinal axis of said tie, clamping means operatively associated with said tie for engaging said tie, said clamping means being positionable between said inclined surface and said concrete form panel and comprising a first clamping member having a first recess of transverse dimension greater than said second transverse dimension and less than said first transverse dimension to accommodate said tie therein, said clamping member being at an angle to the longitudinal axis of said tie, said first recess being defined at least in part by an outwardly inclined clamping surface complementary to said inclined tie surface and engageable therewith, said first clamping member being movable radially with respect to said tie between an engaged position wherein said clamping surface is in engagement with said tie surface to restrain said concrete form panel against outward movement with respect to said tie and a disengaged position wherein said inclined surfaces are not engaged with one another, and means operatively associated with said clamping means for releasably holding said first clamping member in said engaged position.

2. Concrete form panel tying apparatus according to claim 1 wherein said tie further comprises a center portion inwardly of said inner end portion and having a transverse dimension equal to said first transverse dimension.

3. Concrete form panel tying apparatus according to claim 1 wherein substantially all portions of said tie inward of said end portions are of said second transverse dimension.

4. Concrete form panel tying apparatus according to claim 1 further comprising attaching means operatively associated with said clamping means and engageable with said clamping means and with said concrete form panel for releasably attaching said clamping means to a concrete form panel.

5. Concrete form panel tying apparatus according to claim 1 wherein the distance said first clamping member moves between said engaged position and said disengaged position is sufficient only to allow said outer end portion to move axially past said clamping means, whereby said tie is engaged and disengaged by said first clamping member in the course of a relatively short movement of said first clamping member.

6. Concrete form panel tying apparatus according to claim 1 further comprising a second clamping member forming a part of said clamping means, having a second recess, said first and second recesses together defining an aperture having cross-sectional dimensions greater than those of said inner end portion at corresponding points therearound and less than those of said outer end portion at corresponding points therearound, said second recess also being defined by an outwardly inclined clamping surface.

7. Concrete form panel tying apparatuss according to claim 6 wherein said recesses are generally semicircular, whereby the aperture defined thereby is generally circular.

8. Concrete form panel tying apparatus according to claim 6 further comprising fastening means engageable with said clamping members for releasably fastening said clamping members together in said engaged position.

9. Concrete form panel tying apparatus according to claim 6 further comprising means operatively associated with said clamping means for pivotally attaching together said clamping members, whereby said clamping members may be pivotally moved between said engaged position and said disengaged position.

10. Concrete form panel tying apparatus according to claim 6 wherein said end portions and said aperture are generally arcuate in cross-section.

11. Concrete form panel tying apparatus for restraining outward movement of a concrete form panel with respect to a tie passing therethrough, said apparatus comprising:

a tie extendable outwardly through said concrete form panel, an outer end portion on said tie having a first transverse dimension, an inner end portion on said tie located inwardly of said outer end portion and having a second transverse dimension less than said first transverse dimension, a tie surface extending between said outer end portion and said inner end portion at an angle to the longitudinal axis of said tie, clamping means for engaging said tie, said clamping means comprising first and second clamping members, said first clamping member having a first recess and said second clamping member having a second recess, said first and second recesses being defined at least in part, respectively, by first and second clamping member surfaces disposed at angles to the longitudinal axis of said tie and complementary to said tie surface, said first and second recesses being alignable with one another to define an aperture having a transverse dimension greater than said second transverse dimension and less than said first transverse dimension whereby said inner end portion can be received in said aperture with said tie surface in engagement with said clamping member surfaces, said clamping members being movable radially with respect to said tie between engaged positions wherein said tie surface is in engagement with said clamping member surfaces and a disengaged position wherein said tie surface and said clamping member surfaces are disengaged from one another, and means for releasably holding said clamping members in said engaged position.

12. Concrete form panel tying apparatus according to claim 11 wherein each said recess is generally semicircular and said aperture is generally circular, and wherein said clamping members are pivotally attached together, and further comprising fastening means engageable with said clamping members for releasably fastening said clamping members together when in said engaged position.

13. Concrete form panel tying apparatus according to claim 11 further comprising fastening means engageable with said clamping members for releasably fastening said clamping members together when in said engaged position.

14. Concrete form panel tying apparatus for restraining outward movement of a concrete form panel which comprises:

a tie extendable outwardly through an opening in the concrete form panel, said tie including an inner part and an outer part threadedly connected to said inner part for longitudinal movement relative thereto, an outer end portion on said outer part having a first transverse dimension, an inner end portion on said outer part located inwardly of said outer end portion and having a second transverse dimension less than said first transverse dimension, an outwardly inclined tie surface extending between said outer end portion and said inner end portion, clamping means operatively associated with said tie and movable betweens engaged and disengaged positions relative to said tie, said clamping means being positionable between said inclined tie surface and the concrete form panel and having an inclined clamping surface complementary to said inclined tie surface and engaging said inclined tie surface when in said engaged position to restrain said panel against outward movement relative to said tie.

15. Concrete form panel tying apparatus according to claim 14, wherein said outer part comprises an internally threaded sleeve adapted for rotation by a tool.

16. Concrete form panel tying apparatus according to claim 15 wherein said sleeve comprises a nut.

17. Concrete form panel tying apparatus according to claim 1 wherein said inclined tie surface and said inclined clamping surface have a straight slope.

18. Concrete form panel tying apparatus according to claim 1 wherein said inclined tie surface and said inclined clamping surface have curved slopes.

19. Concrete form panel tying apparatus according to claim 5 wherein said inclined tie surface is convex and said inclined clamping surface is concave.

20. Concrete form panel tying apparatus which comprises:

an elongated tie extendable outwardly through an opening in a concrete form panel, said tie having a threaded rod and a nut threadedly connected to said rod for longitudinal movement relative thereto, said nut having a pair of opposed inner and outer shoulders extending transversely of said tie, said nut being smaller in transverse dimension than the opening in said form panel so that said nut can pass completely through said opening from either direction when threaded on said tie, and clamping means connectable to the exterior of the concrete form panel and including a clamping element releasably movable into clamping relation relative to said shoulders to restrain longitudinal movement of said clamping means and the concrete form panel relative to said nut while permitting axial rotation of said nut relative to said clamping means to effect said longitudinal movement of said nut relative to said rod thereby adjusting the positioning of the concrete form panel relative to said rod.

21. Concrete form panel tying apparatus according to claim 20 wherein said nut has a threaded bore extending completely therethrough so that said rod can extend completely through said nut and said nut can move along said rod.

22. Concrete form panel tying apparatus according to claim 21 wherein said shoulders define therebetween a groove in the exterior surface of said nut.

23. Concrete form panel tying apparatus according to claim 22 wherein said outer shoulder is sloped outwardly toward the top of said groove.

24. Concrete form panel tying apparatus according to claim 23 wherein said sloped outer shoulder is convex.

25. Concrete form panel tying apparatus which comprises:

an elongated tie extendable outwardly through an opening in a concrete form panel, said tie having a threaded rod and a nut threadedly connected to said rod for longitudinal movement relative thereto, said nut having a transverse external groove defined by a pair of opposed inner and outer shoulders extending transversely of said tie, a load bearing member adapted to be connected to the exterior of said form panel, said load bearing member having an interior side facing said form panel, an exterior side facing away from said form panel, and an opening through which said tie extends, and a clamping member connected to said load bearing member on the exterior side thereof and releasably movable into clamping relation to the shoulders of said groove when said nut is positioned with said groove adjacent to said exterior side to restrain longitudinal movement of said clamping member, said bearing member and the concrete form panel relative to said nut while permitting axial rotation of said nut relative to said clamping member to effect said longitudinal movement of said nut relative to said rod thereby adjusting the positioning of the concrete form panel relative to said rod.

26. Concrete form panel tying apparatus according to claim 25 wherein a portion of said nut adjacent said groove is disposed within the opening in said bearing means when said clamping engaged in said groove.

27. Concrete form panel tying apparatus according to claim 25 wherein said nut is smaller in transverse dimension than the openings in said form panel and said bearing member so that said nut can pass completely through said openings from either direction when threaded on said tie.

28. Concrete form panel tying apparatus for restraining outward movement of a concrete form panel with respect to a tie passing therethrough, said apparatus comprising:

a tie extendable outwardly through an opening in said concrete form panel;

an outer end portion on said tie having a first transverse dimenion, an inner end portion on said tie located inwardly of said outer end portion and having a second transverse dimension less than said first transverse dimension;

an outwardly inclined transverse shoulder extending between said outer end portion and said inner end portion and curved about the longitudinal axis of said tie; and clamping means operatively associated with said tie for engaging said tie, said clamping means being positionable between said transverse shoulder and said concrete form panel and comprising a clamping member having a recess of transverse dimension greater than said second transverse dimension and less than said first transverse dimension to accommodate said tie therein, said clamping member being at an angle to the longitudinal axis of said tie, said recess being defined at least in part by an outwardly inclined clamping surface complementary to said transverse shoulder and engageable therewith, said clamping member being movable radially with respect to said tie between an engaged position wherein said clamping surface is in engagement with said transverse shoulder to restrain said concrete form panel against outward movement with respect to said tie and a disengaged position wherein said clamping surface and said transverse shoulder are not engaged with one another.

* * * * *